US007911485B2

(12) United States Patent
Rykowski et al.

(10) Patent No.: US 7,911,485 B2
(45) **Date of Patent: *Mar. 22, 2011**

(54) METHOD AND APPARATUS FOR VISUAL DISPLAY CALIBRATION SYSTEM

(75) Inventors: Ronald F. Rykowski, Woodinville, WA (US); Jeffery Scott Harris, Woodinville, WA (US)

(73) Assignee: Radiam Imaging, Inc., Duvall, WA (US)

( * ) Notice: Subject to any disclaimer, the term of this patent is extended or adjusted under 35 U.S.C. 154(b) by 1143 days.

This patent is subject to a terminal disclaimer.

(21) Appl. No.: 10/653,559

(22) Filed: Sep. 2, 2003

(65) Prior Publication Data

US 2004/0246274 A1 Dec. 9, 2004

Related U.S. Application Data

(63) Continuation-in-part of application No. 10/455,146, filed on Jun. 4, 2003.

(51) Int. Cl.
*G09G 5/10* (2006.01)

(52) U.S. Cl. ..... 345/690

(58) Field of Classification Search ..... 345/1.1–1.3, 345/690, 903; 348/179–191, 807, 650, 655
See application file for complete search history.

(56) References Cited

U.S. PATENT DOCUMENTS 4,379,292 A * 4/1983 Minato et al. ..... 345/603
4,825,201 A * 4/1989 Watanabe et al. ..... 345/2.1
4,875,032 A * 10/1989 McManus et al. ..... 345/603
5,479,186 A * 12/1995 McManus et al. ..... 345/11
5,563,621 A * 10/1996 Silsby ..... 345/43
6,020,868 A * 2/2000 Greene et al. ..... 345/88
6,243,059 B1 * 6/2001 Greene et al. ..... 345/88
6,459,425 B1 10/2002 Holub et al.
6,491,412 B1 12/2002 Bowman et al.
6,552,706 B1 * 4/2003 Ikeda et al. ..... 345/96
8,559,826 5/2003 Mendelson et al.
6,611,241 B1 * 8/2003 Firester et al. ..... 345/1.3
6,677,958 B2 * 1/2004 Cottone et al. ..... 345/589

(Continued)

FOREIGN PATENT DOCUMENTS

JP 05-064103 3/1993

(Continued)

OTHER PUBLICATIONS

Jenkins, David R., et al, "Digital imaging colorimeter for fast measurement of chromaticity coordinate and luminance uniformity of displays," Jan. 23, 2001, 12 pages, Radiant Imaging, Chapel Hill, NC, US.

(Continued)

*Primary Examiner* — Sumati Lefkowitz
*Assistant Examiner* — Rodney Amadiz
(74) *Attorney, Agent, or Firm* — Perkins Coie LLP

(57) ABSTRACT

The present disclosure provides methods and apparatuses for calibration of a visual display. In one exemplary implementation of the invention, a visual display module is placed in a test station and a digital camera captures image data from the module. The digital camera can include a CCD digital camera and a lens for imaging. The captured image data is sent to an interface that compiles the data. The interface then calculates correction factors for the image data that may be used to achieve target color and brightness values for the image data. The interface then uploads the correction factors back to the visual display module.

24 Claims, 7 Drawing Sheets

U.S. PATENT DOCUMENTS

| | | | | |
|---|---|---|---|---|
| 6,704,989 | B1 * | 3/2004 | Lutz et al. | 29/428 |
| 6,822,802 | B2 | 11/2004 | Nakano et al. | |
| 7,012,633 | B2 | 3/2006 | Jenkins | |
| 7,161,558 | B1 | 1/2007 | Eidem et al. | |
| 2003/0016198 | A1 * | 1/2003 | Nagai et al. | 345/83 |
| 2003/0156073 | A1 * | 8/2003 | Van Zon | 345/1.1 |
| 2004/0066515 | A1 * | 4/2004 | Ott | 356/418 |
| 2004/0179208 | A1 * | 9/2004 | Hsu | 356/614 |

FOREIGN PATENT DOCUMENTS

| | | |
|---|---|---|
| JP | 2001-22259 | 8/2001 |
| JP | 2003-099003 | 4/2003 |

OTHER PUBLICATIONS

Ohno, Yoshi, "CIE Fundamentals for Color Measurements," 2000, pp. 1-6, IS&T NIP16 Conference, National Institute of Standards and Technology, Gaithersberg, MD, US.

Ohno, Yoshihiro, et al, "Four-Color Matrix Method for Correction of Tristimulus Colorimeters," 1997, pp. 1-5, Proc., IS&T Fifth Color Imaging Conference, 301-305, National Institute of Standards and Technology, Gaithersberg, MD, US.

* cited by examiner

METHOD AND APPARATUS FOR VISUAL DISPLAY CALIBRATION SYSTEM

CROSS-REFERENCE TO RELATED APPLICATION(S)

The present application is a continuation-in-part of U.S. patent application Ser. No. 10/455,146 entitled "METHOD AND APPARATUS FOR ON-SITE CALIBRATION OF VISUAL DISPLAYS" filed Jun. 4, 2003, which is hereby incorporated by reference in its entirety.

TECHNICAL FIELD

The present invention generally relates to brightness and color measurement. More particularly, several aspects of the present invention are related to methods and apparatuses for measuring and calibrating the output from visual display signs.

BACKGROUND

Electronic visual display signs have become commonplace in sports stadiums, arenas, and other public forums throughout the world. These signs can be in a variety of sizes, ranging from small signs measuring just a few inches per side to stadium scoreboards that measure several hundred square feet in size. Electronic visual display signs are assembled and installed using a series of smaller panels, each of which are themselves further comprised of a series of modules. The modules are internally connected to each other by a bus system. A computer or central control unit sends graphic information to the different modules, which then display the graphic information as images and/or text on the sign.

Each module in turn is made up of hundreds of individual light-emitting elements, or "pixels." In turn, each pixel is made up of a plurality of light-emitting points (e.g., one red, one green, and one blue). The light-emitting points are termed "subpixels." During calibration of each module, the color and brightness of each pixel is adjusted so the pixels can display a particular color at a desired brightness level. The adjustment to each pixel necessary to create a color is then stored in software or firmware that controls the module.

Although each module is calibrated during production, the individual subpixels often do not exactly match each other in terms of brightness or color because of manufacturing tolerances. Display manufacturers have tried to remedy this problem by binning subpixels for luminance and color. However, this practice is both expensive and ineffective. The acute ability of the human eye to detect contrast lines in both luminance and color makes it very difficult to blend two modules that were manufactured with subpixels from different binning lots. Furthermore, the electronics powering various modules have tolerances that affect the power and temperature of the subpixels, which in turn affects the color and brightness of the individual subpixels. As the modules age, the light output of each subpixel may degrade.

DETAILED DESCRIPTION

In the following description, numerous specific details are provided, such as the identification of various system components, to provide a thorough understanding of embodiments of the invention. One skilled in the art will recognize, however, that the invention can be practiced without one or more of the specific details, or with other methods, components, materials, etc. In still other instances, well-known structures, materials, or operations are not shown or described in detail to avoid obscuring aspects of various embodiments of the invention.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
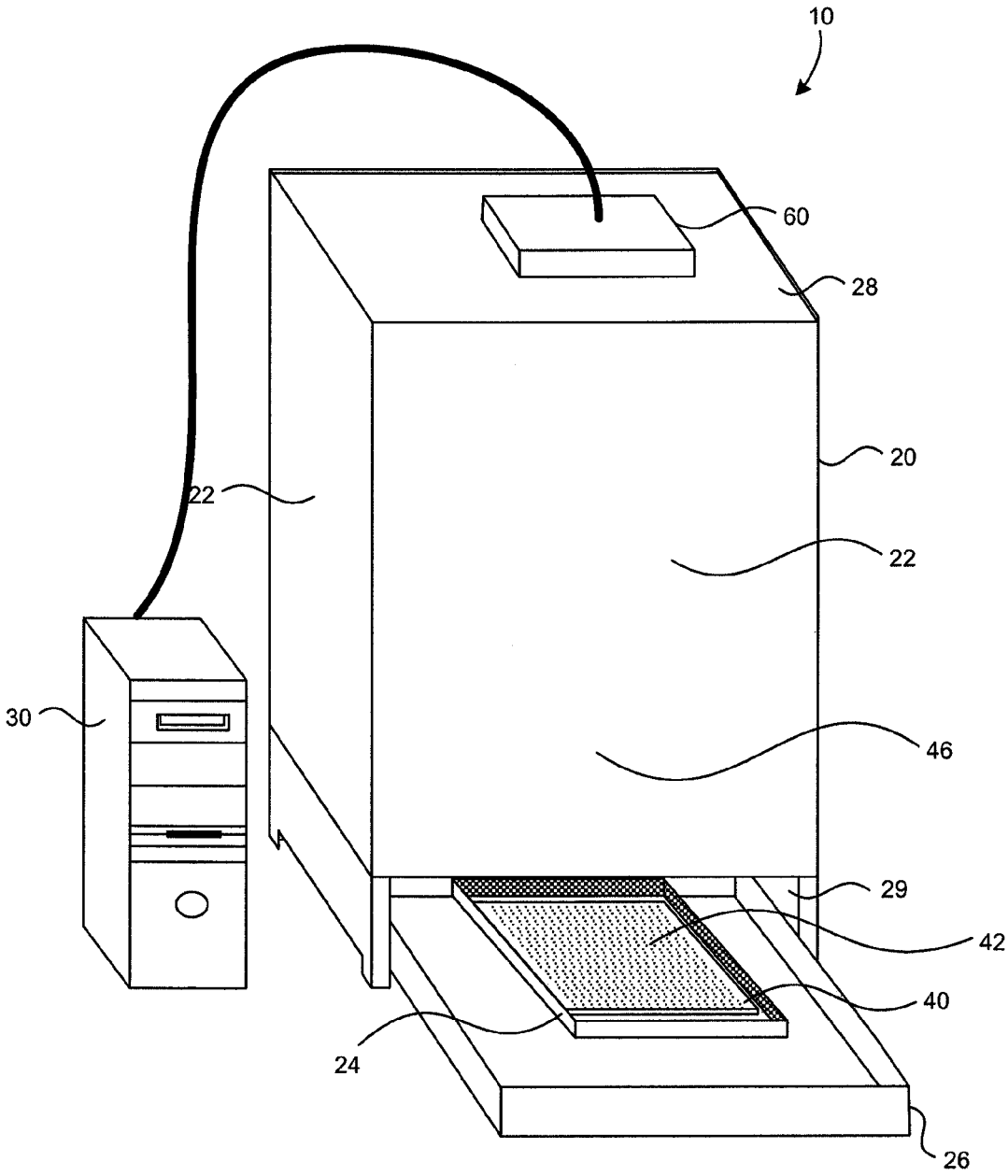
FIG. 1 is an isometric front view of a visual display calibration system in accordance with one embodiment of the invention.

FIG. 1 is a front isometric view of a visual display calibration system 10 in accordance with one embodiment of the invention. The calibration system 10 is configured to perform correction of the brightness and color of light-emitting elements that are used in visual display signs. In one embodiment, the calibration system 10 can include a test station 20, an interface 30, and a visual display module 40. In the embodiment illustrated in FIG. 1, the calibration system 10 is designed to calibrate a single module 40 that is placed within the test station 20. In alternate embodiments, it is possible to calibrate multiple modules within the test station 20.

The test station 20 is configured to capture a series of images from an imaging area 42 on the module 40. The captured image data is transferred from the test station 20 to the interface 30. The interface 30 compiles and manages the image data from each imaging area 42, performs a series of calculations to determine the appropriate correction factors that should be made to the image data, and then stores the data. This process is repeated until images of each display color from the module 40 have been obtained. After collection of all the necessary data, the processed correction data is then uploaded from the interface 30 to the firmware and/or software controlling the module 40 and used to recalibrate the display of the module 40.

In the embodiment illustrated in FIG. 1, the test station 20 includes a lightproof chamber that can be used to calibrate a module 40 in a fully-illuminated room or factory. The test station 20 includes a digital camera 60 mounted on the top portion 28 of the test station 20. The test station 20 further includes light baffles 22 to eliminate any stray light that might be reflected off the walls of the test station chamber back into the camera 60. The test station 20 further includes a nest 24 that is positioned within a drawer 26. In the illustrated embodiment, the drawer 26 is positioned near the bottom portion 29 of the test station 20. The nest 24 includes mechanical and electrical fixtures for receiving the module 40. The module 40 is placed in the nest 24 and the drawer 26 is closed. The module 40 is then in position within the test station 20 for calibration. In one embodiment, the module 40 can range in size up to 0.5 meters on one edge. In alternate embodiments, interchangeable nests can be utilized in the test station 20 to enable the test station to be used with modules of various sizes and configurations.

The test station 20 also incorporates a ground glass diffuser 46 that is positioned just above the module 40. The diffuser 46 scatters the light emitted from each subpixel in the module 40, which effectively partially integrates the emitted light angularly. Accordingly, the camera 60 is actually measuring the average light emitted into a cone rather than only the light traveling directly from each subpixel on the module 40 toward the camera 60. The advantage of this is that the module 40 will be corrected to optimize viewing over a wider angular range.

The interface 30 that is operably coupled to the test station 20 is configured to manage the data that is collected, stored, and used for calculation of new correction factors that will be used to recalibrate the module 40. The interface 30 automates the operation of the test station 20 and writes all the data into a database. In one embodiment, the interface 30 can be a personal computer with software for camera control, image data acquisition, and image data analysis. Optionally, in other embodiments various devices capable of operating the software can be used, such as handheld computers.

It should be understood that the division of the visual display calibration system 10 into three principal components is for illustrative purposes only and should not be construed to limit the scope of the invention. Indeed, the various components may be further divided into subcomponents, or the various components and functions may be combined and integrated. A detailed discussion of the various components and features of the visual display calibration system 10 follows.

Figure 2:
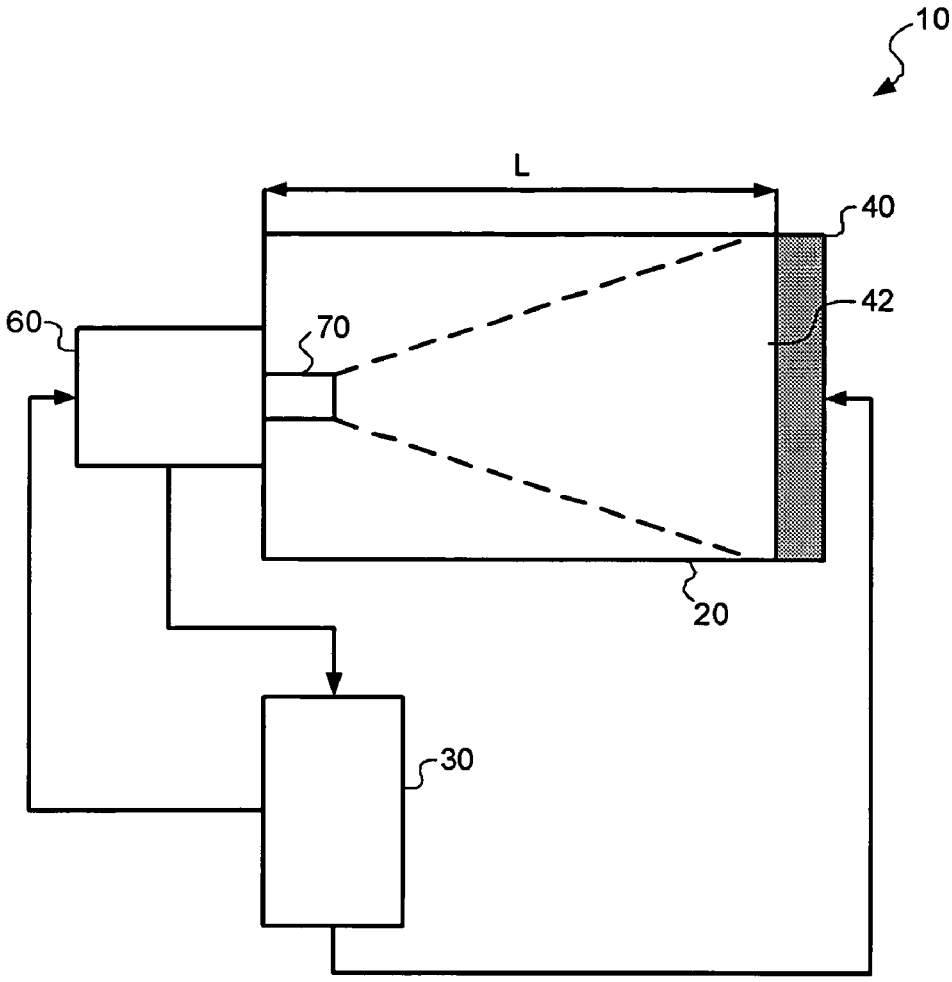
FIG. 2 is a block diagram of the visual display calibration system of FIG. 1.

FIG. 2 is a block diagram of the visual display calibration system 10 described above with respect to FIG. 1. The test station 20 includes a digital camera 60 and a lens 70 to allow for the resolution of each subpixel within the imaging area 42 of the module 40. In one embodiment, the digital camera 60 can be a Charge Coupled Device (CCD) camera. A suitable CCD digital color camera is the ProMetric™ 1400 color camera, which is commercially available from the assignee of the present invention, Radiant Imaging, 15321 Main St. NE, Suite 310, Duvall, Wash. Optionally, in another embodiment a Complementary Metal Oxide Semiconductor (CMOS) camera may be used.

In addition to the digital camera 60, the test station 20 can also include a lens 70. In one embodiment, the lens 70 can be a standard 35 mm camera lens, such as a 50 mm focal length Nikon mount lens, operably coupled to the digital camera 60 to enable the camera to have sufficient resolution to resolve the imaging area 42 on the module 40. In further embodiments, a variety of lenses may be used as long as the particular lens provides sufficient resolution and field-of-view for the digital camera 60 to adequately capture image data within the imaging area 42.

The module 40 enclosed in the test station 20 is positioned at a distance L from the camera 60. The distance L between the module 40 and the camera 60 will vary depending on the size of each module. In one embodiment, the module 40 is positioned at a distance of 1.5 meters. In other embodiments, however, the distance L can vary.

The visual display calibration system 10 further includes the interface 30. The interface 30 includes image software to control the test station 20 as well as measurement software to find each subpixel in an image and extract the brightness and color data from the subpixel. The software should be flexible enough to properly find and measure each subpixel, even if the alignment of the camera and module is not ideal. Further, the software in the interface 30 is adaptable to various sizes and configurations of modules. For example, in one embodiment, the interface 30 is capable of measuring up to 8,000 subpixels in a single module. Suitable software for the interface 30, such as ProMetric™ v. 7.2, is commercially available from the assignee of the present invention, Radiant Imaging, 15321 Main St. NE, Suite 310, Duvall, Wash.

The interface 30 also includes a database. The database is used to store data for each subpixel, including brightness, color coordinates, and calculated correction factors. In one embodiment, the database is a Microsoft® Access database designed by the assignee of the present invention, Radiant Imaging, 15321 Main St. NE, Suite 310, Duvall, Wash. The stored correction data is then uploaded to the firmware and/or software that is controlling the module 40.

Figure 3:
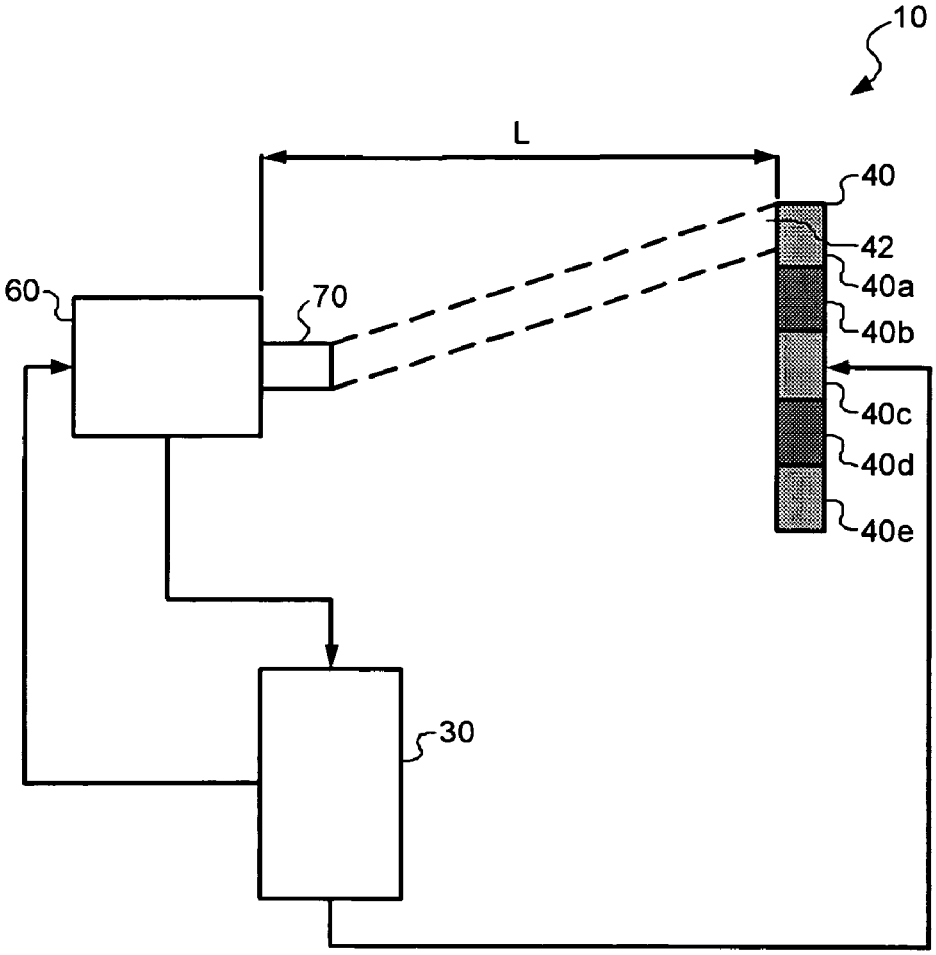
FIG. 3 is a block diagram of another embodiment of the visual display calibration system.

FIG. 3 is a block diagram of the visual display calibration system 10 in accordance with another embodiment of the invention. In this embodiment, the visual display calibration system 10 is used in a darkroom. The calibration system 10 can be used to calibrate either a single module 40 or a plurality of modules, illustrated here as modules 40*a*-40*e*. The calibration system 10 is flexible in that it can calibrate any number of modules that can fit into the darkroom at any one time.

The digital camera 60 and lens 70 are configured to capture an image of all the modules 40*a*-40*e* at once. In an optional embodiment, images of an imaging area 42 of the modules 40*a*-40*e* can be captured sequentially. The captured image data is then transferred from the digital camera 60 to the interface 30. The interface 30 compiles and manages the image data from each imaging area 42, performs a series of calculations to determine the appropriate correction factors that should be made for each pixel of the modules 40*a*-40*e*, and then stores the data. This process is repeated until images of each color from the entire set of modules 40*a*-40*e* have been obtained. After collection of all necessary data, the processed correction data is then uploaded from the interface 30 to the firmware and/or software controlling the modules 40*a*-40*e* and used to calibrate the display of the modules.

Figure 4:
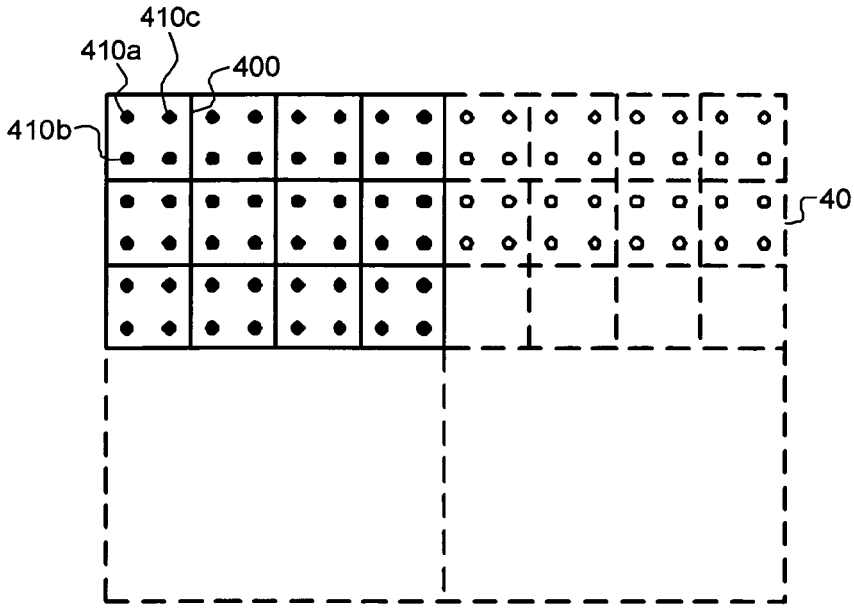
FIG. 4 is an enlarged isometric view of a panel of the visual display sign of FIG. 1.

FIG. 4 is an enlarged isometric view of a portion of a visual display module 40. Each module 40 is made up of hundreds of individual light-emitting elements 400, or "pixels." In turn, each pixel 400 is made up of three light-emitting points, subpixels 410*a*-410*c*, which are often referred to as light-emitting diodes (LED). In one embodiment, the subpixels 410*a*-410*c* are red, green, and blue, respectively. In other embodiments, however, the number of subpixels may be more than three. For example, some pixels may have four subpixels (e.g., two green subpixels, one blue subpixel, and one red subpixel). Furthermore, in some embodiments, the red, green, and blue (RGB) color space may not be used. Rather, a different color space can serve as the basis for processing and display of color images on the module 40. For example, the subpixels 410*a*-410*c* may be cyan, magenta, and yellow, respectively.

Figure 5:
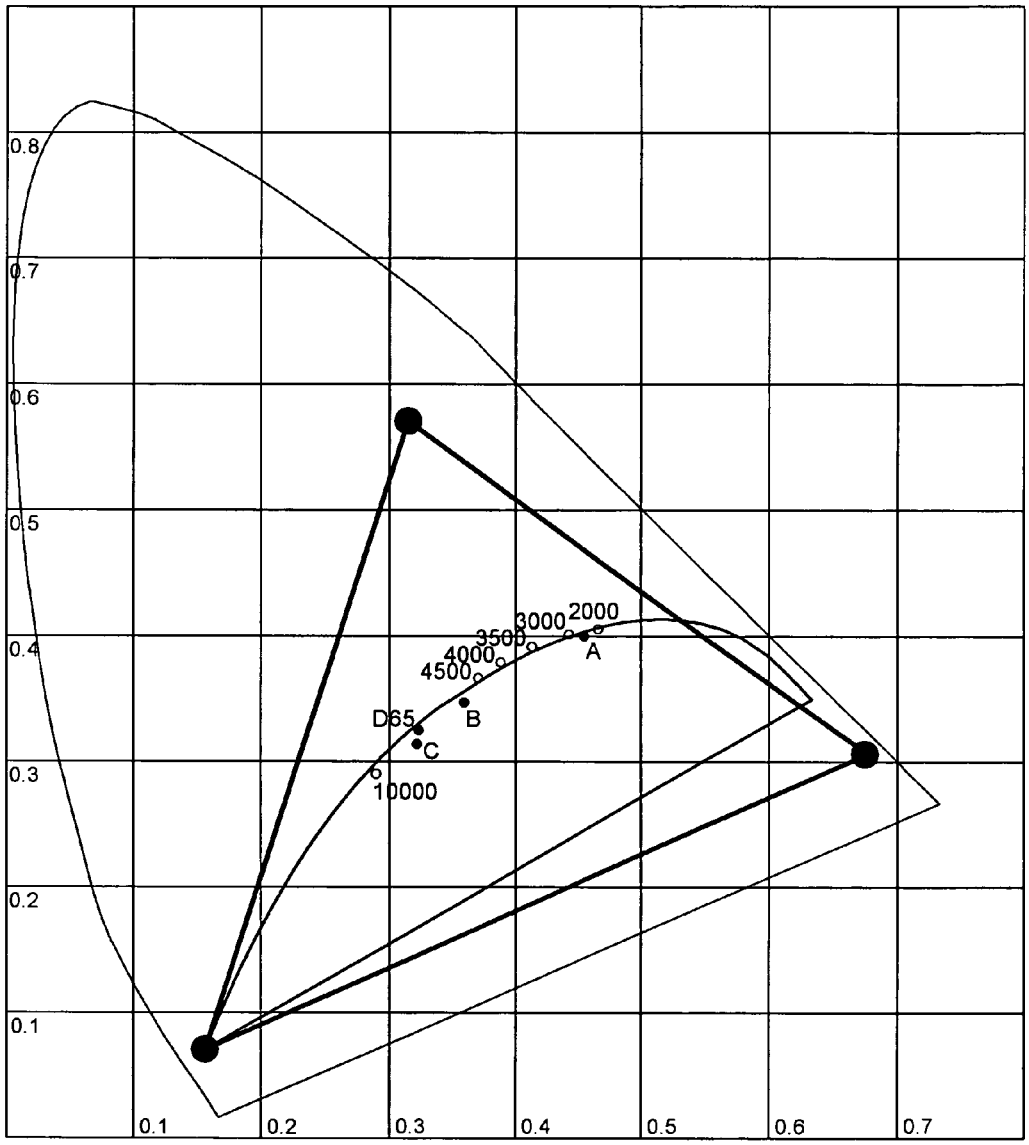
FIG. 5 is a diagram of a color gamut triangle.

The brightness level of each subpixel 410*a*-410*c* in the module 40 can be varied. Accordingly, the additive primary colors represented by the red subpixel 410*a*, the green subpixel 410*b*, and the blue subpixel 410*c* can be selectively combined to produce the colors within the color gamut defined by a color gamut triangle, as shown in FIG. 5. For example, when only "pure" red is displayed, the green and blue subpixels may be turned on slightly to achieve a specific chromaticity for the red color.

Calibration of the module 40 requires highly accurate measurements of the color and brightness of each subpixel 410*a*-410*c*. Typically, the accuracy required for the measurement of individual subpixels can only be achieved with a spectral radiometer. Subpixels are particularly difficult to measure accurately with a colorimeter because they are narrow-band sources, and a small deviation in the filter response at the wavelength of a particular subpixel can result in significant measurement error. Colorimeters rely on color filters that can have small imperfections in spectral response. In the illustrated embodiment, however, the calibration system 10 utilizes a colorimeter. The problem with small measurement errors has been overcome by correcting for the errors using software in the interface 30 to match the results of a spectral radiometer. For a detailed overview of the software corrections, see "Digital Imaging Colorimeter for Fast Measurement of Chromaticity Coordinate and Luminance Uniformity of Displays," Jenkins et al., Proc. SPIE Vol. 4295, Flat Panel Display Technology and Display Metrology II, Edward F. Kelley Ed., 2001. The article is incorporated herein by reference.

Figure 6:
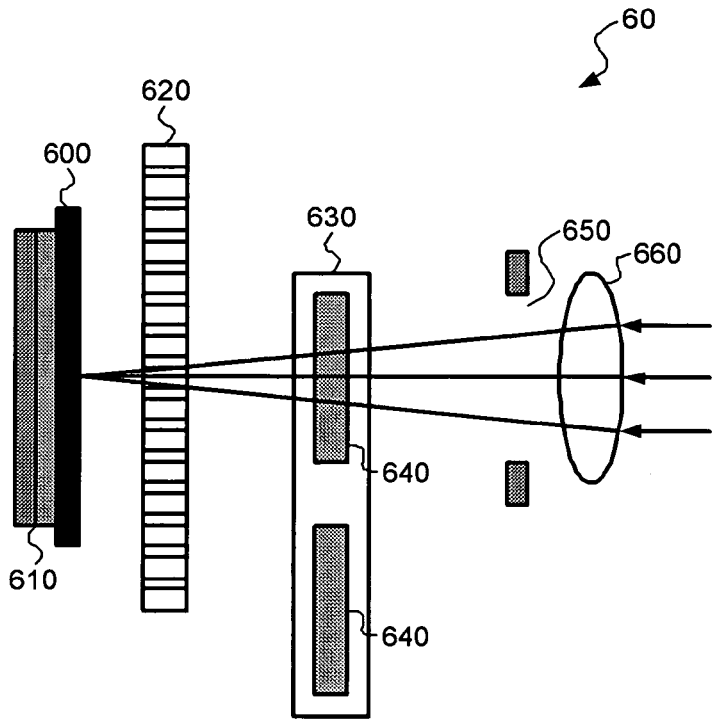
FIG. 6 is a detailed schematic view of a CCD digital color camera in accordance with one embodiment of the invention.

FIG. 6 is a detailed schematic view of the CCD digital camera 60 (FIG. 2 or 3). The camera 60 can include an imaging lens 660, a lens aperture 650, color correction filters 640 in a computer-controlled filter wheel 630, a mechanical shutter 620, and a CCD imaging array 600. In operation, light from the module 40 (FIG. 2 or 3) enters the imaging lens 660 of the camera 60. The light then passes through the lens aperture 650, through a color correction filter 640 in the computer-controlled filter wheel 630, and through the mechanical shutter 620 before being imaged onto the imaging array 600.

A two-stage Peltier cooling system using two back-to-back thermoelectric coolers 610 (TECs) operates to control the temperature of the CCD imaging array 600. The cooling of the CCD imaging array 600 within the camera 60 allows it to operate at 14-bits analog to digital conversion with approximately 2 bits of noise (i.e., 4 grayscale units of noise out of a possible 16,384 maximum dynamic range). A 14-bit CCD implies that up to $2^{14}$ or 16,384 grayscale levels of dynamic range are available to characterize the amount of light incident on each pixel.

The CCD imaging array 600 comprises a plurality of light-sensitive cells or pixels that are capable of producing an electrical charge proportional to the amount of light they receive. The pixels in the CCD imaging array 600 are arranged in a two-dimensional grid array. The number of pixels in the horizontal or x-direction and the number of pixels in the vertical or y-direction constitute the resolution of the CCD imaging array 600. For example, in one embodiment the CCD imaging array 600 has 1,536 pixels in the x-direction and 1,024 pixels in the y-direction. Thus, the resolution of the CCD imaging array 600 is 1,572,864 pixels, or 1.6 megapixels.

The resolution of the CCD imaging array 600 must be sufficient to resolve the imaging area 42 (FIG. 2 or 3) on the module 40 (FIG. 2 or 3). In one embodiment, the resolution of the CCD imaging array 600 is such that 50 pixels on the CCD imaging array 600 correspond to one subpixel (e.g., subpixel 410*a* (FIG. 4)) on the module 40 (FIG. 2 or 3). By way of example, in one embodiment the CCD digital camera 60 has a resolution of 1,572,864 pixels. Assuming that fifty pixels of resolution from the CCD digital camera 60 corresponds to one subpixel on the module 40, then the CCD digital camera 60 can capture data from 31,457 subpixels on the module 40 (1,572,864 pixels from the camera/50) in a single captured image. In other embodiments, the correlation between the resolution of the CCD imaging array 600 and the module 40 can vary between 10 to 200 pixels on the CCD imaging array 600 corresponding to one subpixel on the module 40. Each subpixel captured by the CCD imaging array 600 can be characterized by its color value, typically expressed as chromaticity (Cx, Cy), and its brightness, typically expressed as luminance $L^v$.

Figure 7:
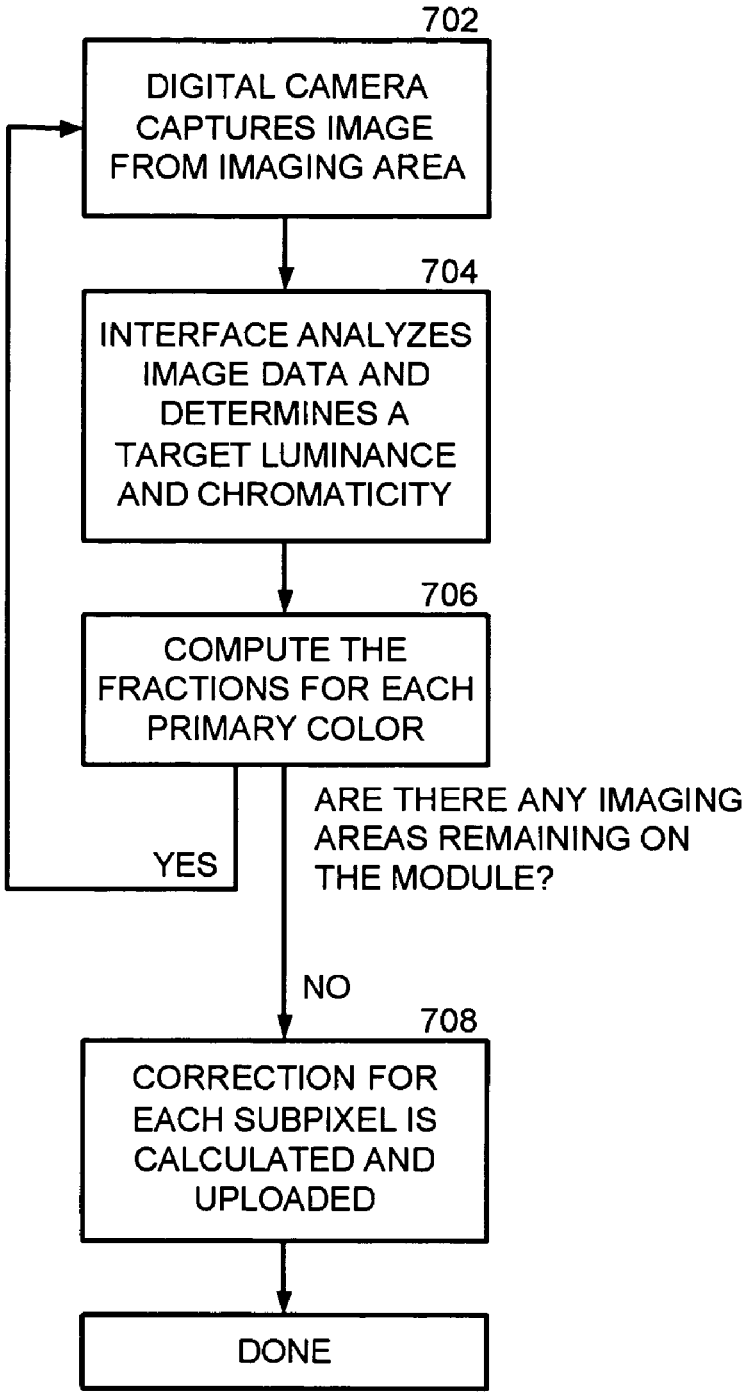
FIG. 7 is a flow diagram illustrating a method of the present invention.

The method of the present invention is shown in FIG. 7. Beginning at box 702, the digital camera scans a first imaging area on the module and captures an image. The size of the imaging area, as discussed previously, depends on the resolution of the digital camera. The required image data can be obtained by measuring the three light sources independently (red, green, and blue) at nominal intensity for both luminance and chromaticity coordinates. The luminance and chromaticity coordinates for light source n are $L_n$, $Cx_n$, and $Cy_n$.

After the image is captured, at box 704 the image data is sent to the interface. The interface is programmed to calculate a three-by-three matrix of values that indicate some fractional amount of power to turn on each subpixel for each primary color. A sample matrix is displayed below:

| Fractional values for each subpixel | | | |
|---|---|---|---|
| Primary color | Red | Green | Blue |
| Red | 0.60 | 0.10 | 0.05 |
| Green | 0.15 | 0.70 | 0.08 |
| Blue | 0.03 | 0.08 | 0.75 |

For example, when red is displayed on the screen, the screen will turn on each red subpixel at 60% power, the green subpixels at 10% power, and the blue subpixels at 5% power. The following discussion details how this matrix is determined.

The goal is to determine the relative luminance levels of three given light sources (e.g., red, green, and blue subpixels) to produce specified target chromaticity coordinates Cx and Cy. The first step is to compute the luminance target for each color. This can be done using the following equations, where $L_1$, $L_2$, and $L_3$ are set to 1 and the source chromaticity values are the target chromaticity values for each primary color. The following equations are used to calculate tristimulus values for each light source:

$$Cx_n \equiv \frac{X_n}{X_n + Y_n + Z_n}, \quad Cy_n \equiv \frac{Y_n}{X_n + Y_n + Z_n}. \text{ or}$$

$$Y_n = L_n,\ X_n = \frac{Cx_n}{Cy_n} \cdot Y_n,\ Z_n = \frac{1 - Cx_n - Cy_n}{Cy_n} \cdot Y_n$$

Next, calculate tristimulus values for the target chromaticity coordinates:

$$Cx_t \equiv \frac{X_t}{X_t + Y_t + Z_t}, \quad Cy_t \equiv \frac{Y_t}{X_t + Y_t + Z_t}. \text{ or}$$

$$Y_t = L_t, \quad X_t = \frac{Cx_t}{Cy_t} \cdot Y_t,\ Z_t = \frac{1 - Cx_t - Cy_t}{Cy_t} \cdot Y_t$$

where the target luminance $L_t = L_1 + L_2 + L_3$.

The next step is to determine the fractional luminance levels of the three light sources. Colors can be produced by combining the three light sources at different illumination levels. This is represented by the following equations:

$$X_t = a \cdot X_1 + b \cdot X_2 + c \cdot X_3$$

$$Y_t = a \cdot Y_1 + b \cdot Y_2 + c \cdot Y_3$$

$$Z_t = a \cdot Z_1 + b \cdot Z_2 + c \cdot Z_3$$

where a, b, and c are the fractional values of luminance produced by the source measured in the first step. For example, if a=0.5, then light source 1 should be turned on at 50% of the intensity measured in the first step to produce the desired color.

We can write the above system of equations as $$\begin{pmatrix} X_t \\ Y_t \\ Z_t \end{pmatrix} = A \cdot \begin{pmatrix} a \\ b \\ c \end{pmatrix} \text{ where } A = \begin{pmatrix} X_1 & X_2 & X_3 \\ Y_1 & Y_2 & Y_3 \\ Z_1 & Z_2 & Z_3 \end{pmatrix}$$

We can then solve for a, b, and c as $$\begin{pmatrix} a \\ b \\ c \end{pmatrix} = A^{-1} \cdot \begin{pmatrix} X_t \\ Y_t \\ Z_t \end{pmatrix}$$

where $$A^{-1} = \frac{1}{Det(A)} \begin{pmatrix} Y_2Z_3 - Y_3Z_2 & X_3Z_2 - X_2Z_3 & X_2Y_3 - X_3Y_2 \\ Y_3Z_1 - Y_1Z_3 & X_1Z_3 - X_3Z_1 & X_3Y_1 - X_1Y_3 \\ Y_1Z_2 - Y_2Z_1 & X_2Z_1 - X_1Z_2 & X_1Y_2 - X_2Y_1 \end{pmatrix}$$

(by Cramer's Rule) and $Det(A)=X_1 \cdot (Y_2Z_3-Y_3Z_2)-Y_1 \cdot (X_2Z_3-X_3Z_2)+Z_1 \cdot (X_2Y_3-X_3Y_2)$.

The calculated a, b, and c fractions are the target luminance for each primary color.

At box 706, the next step is to compute the fractions for each primary color. Again, the same formulas as described above are applied. This time, however, the source luminance and chromaticity is that of each subpixel, as measured by the imaging device in box 702. The target is the chromaticity and luminance for each primary color, which was determined at box 704. The following equations are used to calculate tristimulus values for each light source:

$$Cx_n \equiv \frac{X_n}{X_n + Y_n + Z_n},\ Cy_n \equiv \frac{Y_n}{X_n + Y_n + Z_n}. \text{ or}$$

$$Y_n = L_n,\ X_n = \frac{Cx_n}{Cy_n} \cdot Y_n,\ Z_n = \frac{1 - Cx_n - Cy_n}{Cy_n} \cdot Y_n$$

Next, calculate tristimulus values for the target chromaticity coordinates:

$$Cx_t \equiv \frac{X_t}{X_t + Y_t + Z_t},\ Cy_t \equiv \frac{Y_t}{X_t + Y_t + Z_t}. \text{ or}$$

$$Y_t = L_t,\ X_t = \frac{Cx_t}{Cy_t} \cdot Y_t,\ Z_t = \frac{1 - Cx_t - Cy_t}{Cy_t} \cdot Y_t$$

where the target luminance $L_t=L_1+L_2+L_3$.

The next step is to determine the fractional luminance levels of the three light sources. Colors can be produced by combining the three light sources at different illumination levels. This is represented by the following equations:

$$X_t = a \cdot X_1 + b \cdot X_2 + c \cdot X_3$$

$$Y_t = a \cdot Y_1 + b \cdot Y_2 + c \cdot Y_3$$

$$Z_t = a \cdot Z_1 + b \cdot Z_2 + c \cdot Z_3$$

where a, b, and c are the fractional values of luminance produced by the source measured in the first step. We can write the above system of equations as $$\begin{pmatrix} X_t \\ Y_t \\ Z_t \end{pmatrix} = A \cdot \begin{pmatrix} a \\ b \\ c \end{pmatrix} \text{ where } A = \begin{pmatrix} X_1 & X_2 & X_3 \\ Y_1 & Y_2 & Y_3 \\ Z_1 & Z_2 & Z_3 \end{pmatrix}$$

We can then solve for a, b, and c as $$\begin{pmatrix} a \\ b \\ c \end{pmatrix} = A^{-1} \cdot \begin{pmatrix} X_t \\ Y_t \\ Z_t \end{pmatrix}$$

where $$A^{-1} = \frac{1}{Det(A)} \begin{pmatrix} Y_2Z_3 - Y_3Z_2 & X_3Z_2 - X_2Z_3 & X_2Y_3 - X_3Y_2 \\ Y_3Z_1 - Y_1Z_3 & X_1Z_3 - X_3Z_1 & X_3Y_1 - X_1Y_3 \\ Y_1Z_2 - Y_2Z_1 & X_2Z_1 - X_1Z_2 & X_1Y_2 - X_2Y_1 \end{pmatrix}$$

(by Cramer's Rule) and $Det(A)=X_1 \cdot (Y_2Z_3-Y_3Z_2)-Y_1 \cdot (X_2Z_3-X_3Z_2)+Z_1 \cdot (X_2Y_3-X_3Y_2)$.

Now, a, b, and c represent the fractional luminance levels of the three light sources needed to produce a target color (Cx, Cy) at the maximum luminance possible. This calculation is repeated three times, once for each color. This provides three sets of three a, b, and c fractions, which are the components of the three-by-three matrix discussed above.

Note that if any of the values a, b, or c are negative, the desired chromaticity coordinate cannot be produced by any combination of the three light sources because it is outside the color gamut. A negative value would indicate a negative amount of luminance for a given subpixel, which of course can not occur. The above formulas, however, do not take this into account. Accordingly, two other fractions are set at levels that produce more light than is needed to hit the target luminance, and they must be reduced. This is done as follows:

TotalLuminance=*a**RedLuminance+
*b**GreenLuminance+*c**BlueLuminance

ScaleFactor=TotalLuminance/(*b**GreenLuminance+
*c**BlueLuminance)

b=b*ScaleFactor
c=c*ScaleFactor
a=0

Note that ScaleFactor will always be less than 1 because TotalLuminance includes the negative value. Also note that although we do achieve the target luminance, the target chromaticity is not quite achieved in this case.

At box 708, the calculated correction determined above is uploaded from the interface to the firmware or software controlling the module. The module is then recalibrated using the new data for each subpixel.

One advantage of the foregoing embodiments of the visual display calibration system is its efficiency and cost-effectiveness in recalibrating modules. The visual sign calibration system provides an effective way to calibrate modules in the factory, ensuring that they are properly adjusted before being assembled into large visual display signs. Furthermore, the calibration system is flexible enough to calibrate either a single module or a plurality of modules simultaneously in a darkroom or in a test station.

Another advantage of the embodiments described above is the capability of the CCD digital camera to capture large amounts of data in a single image. For example, the two-dimensional array of pixels on the CCD imaging array is capable of capturing a large number of data points from the visual display sign in a single captured image. By capturing thousands, or even millions, of data points at once, the process of calibrating the modules of a visual display sign is accurate and cost-effective.

While the invention is described and illustrated here in the context of a limited number of embodiments, the invention may be embodied in many forms without departing from the spirit of the essential characteristics of the invention. The illustrated and described embodiments are therefore to be considered in all respects as illustrative and not restrictive. Thus, the scope of the invention is indicated by the appended claims rather than by the foregoing description, and all changes that come within the meaning and range of equivalency of the claims are intended to be embraced therein.

We claim:

1. A method for calibrating a visual display, the method comprising:

(a) analyzing a visual display module, the module comprising an array of pixels and corresponding subpixels;

(b) locating and registering multiple subpixels of the visual display module;

(c) determining a chromaticity value and a luminance value for each registered subpixel;

(d) converting the chromaticity and luminance value for each registered subpixel value to measured tristimulus values;

(e) converting a target chromaticity value and a target luminance value for a given color to target tristimulus values;

(f) calculating correction factors for each registered subpixel based on a difference between the measured tristimulus values and the target tristimulus values; and (g) sending the correction factors to the visual display module.

2. The method of claim 1, further comprising:

(h) setting the visual display module image to the color red;

(i) repeating steps (a) to (f); and (i) repeating steps (h) and (i) with the visual display sign image set to green, blue, and white.

3. The method of claim 1 wherein the subpixels are light-emitting diodes.

4. The method of claim 1 wherein the process in step (c) for determining the chromaticity value and luminance value for each subpixel includes the use of an imaging colorimeter.

5. The method of claim 1 wherein the process in step (g) for sending the correction factors to the visual display module comprises uploading the corrected subpixel values to firmware and/or software controlling the visual display module.

6. The method of claim 1 wherein steps (a) to (g) take place within a test station.

7. The method of claim 1 wherein steps (a) to (g) take place in a darkroom.

8. The method of claim 1 wherein sending the correction factors to the visual display module comprises calibrating the module with the adjusted subpixel values.

9. A method for calibrating a visual display, the method comprising:

(a) analyzing a portion of a visual display module, the portion comprising an array of pixels and corresponding subpixels;

(b) locating and registering multiple subpixels within the array (c) determining a chromaticity value and a luminance value for each registered subpixel within the array;

(d) storing the chromaticity value and the luminance value for each subpixel;

(e) repeating steps (a) to (d) for each portion of the visual display module until all portions of the visual display module have been analyzed;

(f) converting the chromaticity value and luminance value for each registered subpixel to measured tristimulus values;

(g) converting a target chromaticity value and a target luminance value for a given color to target tristimulus values;

(h) calculating correction factors for each subpixel based on a difference between the measured tristimulus values and the target tristimulus values;

(i) applying the correction factors to the stored chromaticity and luminance values for each subpixel; and (j) calibrating the visual display module with the corrected subpixel values.

10. The method of claim 9, further comprising:

(k) setting the visual display module to project the color red;

(l) repeating steps (a) to (i); and (m) repeating steps (k) and (l) with the visual display module set to green, blue, and white.

11. The method of claim 9 wherein the subpixels are light-emitting diodes.

12. The method of claim 9 wherein the pixels are pixels of a liquid crystal display (LCD).

13. The method of claim 9 wherein the process in step (c) for determining the chromaticity value and luminance value for each registered subpixel includes the use of an imaging colorimeter.

14. The method of claim 9 wherein the process in step (d) for storing the chromaticity value and luminance value for each subpixel comprises storing the data in a database.

15. The method of claim 9 wherein the process in step (h) for calculating correction factors for each subpixel includes processing the data using a computer and software.

16. The method of claim 9 wherein the process in step (j) for calibrating the visual display module further comprises uploading the corrected subpixel values to firmware and/or software controlling the visual display panel.

17. The method of claim 9 wherein steps (a) to (j) take place within a test station.

18. The method of claim 9 wherein steps (a) to (j) take place in a darkroom.

19. An apparatus for analyzing and calibrating a visual display, comprising:

means for capturing an image from a portion of the visual display module positioned within a testing station;

means for determining a chromaticity and a luminance value for each of a plurality of subpixels from the captured image;

means for converting the chromaticity values and luminance values for each of the subpixels to measured tristimulus values;

means for converting a target chromaticity value and a target luminance value for a given color to target tristimulus values; and means for adjusting the tristimulus values for each subpixel to correspond with the target tristimulus values.

20. The apparatus of claim 19 wherein the means for capturing the image comprises a CCD digital camera and lens.

21. The apparatus of claim 19 wherein the means for capturing the image comprises a CMOS digital camera and lens.

22. The apparatus of claim 19 wherein the means for determining the chromaticity and the luminance values for a plurality of subpixels comprises software loaded in an interface, the interface being operably coupled to both the capturing means and the visual display module.

23. The apparatus of claim 19 wherein the means for adjusting the tristimulus values for each subpixel comprises software for calculating a set of correction factors to be applied to each subpixel and uploading the correction factors to the visual display module.

24. A method for calibrating a visual display module having an array of pixels and corresponding subpixels, the method comprising:

(a) locating and registering multiple subpixels of the visual display module carried by a testing station with a flat-fielded imaging photometer;

(b) calculating chromaticity coordinates ($C_x$, $C_y$) and luminance values (L) for each of the registered subpixels;

(c) converting the chromaticity coordinates and luminance values for each registered subpixel to measured tristimulus values ($X_m$, $Y_m$, $Z_m$);

(d) converting a target chromaticity value and a target luminance value for a given color to target tristimulus values ($X_t$, $Y_t$, $Z_t$);

(e) calculating correction factors for each registered subpixel based on a difference between the measured tristimulus values ($X_m$, $Y_m$, $Z_m$) and the target tristimulus values ($X_t$, $Y_t$, $Z_t$), wherein the correction factor for each registered subpixel includes a three by three matrix of values that indicates some fractional amount of power to turn on each registered subpixel for a given color; and (f) calibrating the visual display module with the adjusted values for each registered subpixel.

* * * * *